US010334383B2

(12) United States Patent
Sun et al.

(10) Patent No.: US 10,334,383 B2
(45) Date of Patent: Jun. 25, 2019

(54) METHOD, DEVICE AND TERMINAL FOR IMPROVING SOUND QUALITY OF STEREO SOUND

(71) Applicant: ZTE CORPORATION, Shenzhen (CN)

(72) Inventors: Tao Sun, Shenzhen (CN); Jinjun Wang, Shenzhen (CN); Hua Xue, Shenzhen (CN)

(73) Assignee: ZTE Corporation, Shenzhen (CN)

( * ) Notice: Subject to any disclaimer, the term of this patent is extended or adjusted under 35 U.S.C. 154(b) by 239 days.

(21) Appl. No.: 15/319,886

(22) PCT Filed: Oct. 24, 2014

(86) PCT No.: PCT/CN2014/089489

§ 371 (c)(1),
(2) Date: Apr. 7, 2017

(87) PCT Pub. No.: WO2015/192577

PCT Pub. Date: Dec. 23, 2015

(65) Prior Publication Data

US 2017/0230774 A1 Aug. 10, 2017

(30) Foreign Application Priority Data

Jun. 18, 2014 (CN) ..... 2014 1 0273578

(51) Int. Cl.
*H04S 7/00* (2006.01)
*H04R 5/04* (2006.01)
*H04S 1/00* (2006.01)

(52) U.S. Cl.
CPC ..... *H04S 7/30* (2013.01); *H04R 5/04* (2013.01); *H04S 1/007* (2013.01)

(58) Field of Classification Search
CPC combination set(s) only.
See application file for complete search history.

(56) References Cited

U.S. PATENT DOCUMENTS 4,980,914 A * 12/1990 Kunugi ..... H03G 5/04 381/1
5,991,609 A * 11/1999 Marrah ..... H04B 1/18 455/182.2

(Continued)

FOREIGN PATENT DOCUMENTS

CN 1937854 A 3/2007
CN 1942017 A 4/2007

(Continued)

OTHER PUBLICATIONS

PCT International Search Report dated Mar. 24, 2015, Application No. PCT/CN2014/089489, 3 Pages.

(Continued)

*Primary Examiner* — Duc Nguyen
*Assistant Examiner* — Assad Mohammed
(74) *Attorney, Agent, or Firm* — Plumsea Law Group, LLC

(57) ABSTRACT

Provided are a method and device for improving sound quality of stereo sound and a terminal. The method includes: an original left channel signal and an original right channel signal are acquired; phases, frequency spectrums and amplitudes of the original left channel signal and original right channel signal are acquired; a left calibrated signal is acquired according to the phase, frequency spectrum and amplitude of the original left channel signal, and a right calibrated signal is acquired according to the phase, frequency spectrum and amplitude of the original right channel signal; the left calibrated signal and the original right channel signal are superposed to generate a final right channel output signal; the right calibrated signal and the original left channel signal are superposed to generate a final left channel output signal; the final right channel output (Continued)

signal and the final left channel output signal are combined to form a PCM signal.

8 Claims, 6 Drawing Sheets

(56) References Cited

U.S. PATENT DOCUMENTS

| | | | | |
|---|---|---|---|---|
| 6,160,953 | A * | 12/2000 | Fuchigami | G11B 20/10527 386/339 |
| 8,050,433 | B2 | 11/2011 | Kim | |
| 8,077,815 | B1 * | 12/2011 | Johnston | H04S 7/30 375/316 |
| 8,254,583 | B2 | 8/2012 | Kim | |
| 2005/0286727 | A1 * | 12/2005 | Otsuka | H04R 5/02 381/18 |
| 2008/0019538 | A1 * | 1/2008 | Kushner | A62B 18/08 381/94.1 |
| 2008/0085010 | A1 | 4/2008 | Suzuki | |
| 2014/0093109 | A1 | 4/2014 | Bazarjani et al. | |

FOREIGN PATENT DOCUMENTS

| | | | |
|---|---|---|---|
| CN | 101212843 | A | 7/2008 |
| JP | 2007214726 | A | 8/2007 |
| JP | 200901697 | A | 4/2009 |

OTHER PUBLICATIONS

Extended European Search Report dated May 18, 2017, Application No. 14895002.5, 9 Pages.

* cited by examiner

METHOD, DEVICE AND TERMINAL FOR IMPROVING SOUND QUALITY OF STEREO SOUND

CROSS-REFERENCE TO RELATED APPLICATIONS

This application is a U.S. national phase of PCT Application No. PCT/CN2014/089489 filed on Oct. 24, 2014, which claims priority to Chinese Patent Application No. 201410273578.4 filed on Jun. 18, 2014, the disclosures of which are incorporated in their entirety by reference herein.

TECHNICAL FIELD

The present disclosure relates to a sound processing technology, and more particularly to a method and device for improving sound quality of stereo sound and a terminal.

BACKGROUND

A mobile terminal has a small volume, so its internal circuit design and Printed Circuit Board PCB layout are greatly limited. A COder-DECoder codec and a stereo sound output port of many mobile terminals are at a far distance and even on different PCBs, which causes a large impedance between the codec and the stereo sound output port. Especially, the impedances from the stereo sound output port and its matched return current ground to the codec are comparatively large. If a small-impedance sound production device is connected with the stereo sound output port, for example, a 16-ohm or a 32-ohm headphone, and since a left channel and a right channel share the common return current ground, a divided voltage of an electrical signal of the left channel on the return current ground will affect the right channel, and vice versa. When listening to stereo music, the fidelity of music signals of the left and right channels will be distorted. The difference of frequencies, phases and amplitudes of the sound signals of the left and right channels causes a severe crosstalk, so the sound quality of stereo sound is deteriorated, and even the user listening experience is seriously affected.

The existing method for improving the stereo sound crosstalk of a terminal is to reduce the impedance from the return current ground of the stereo sound output port to the codec as possible, and widen lines, or try to make sure that the stereo sound output port and its return current ground and the codec are on the same PCB. The method will bring a very significant influence on the PCB layout of the terminal and even the degree of freedom of Industrial Design ID, for example, a headphone jack is constrainedly designed near the codec on the PCB, but according to that, form the appearance, the position of the headphone jack on the terminal is not reasonable. Or the number of PCBs is increased to reduce a return current impedance Rgnd, but the cost of the terminal is increased.

Or, an extra codec chip is adopted and designed near the stereo sound port of the terminal, but this method still increases the cost and the pressure of the PCB layout.

The existing art has the following problem: whether the measure of reducing the impedance from the return current ground of the stereo sound output port to the codec or the measure of adopting the extra codec chip will increase the cost and affect the PCB layout.

SUMMARY

The technical problem to be solved by the present disclosure is to provide a method, device for improving sound quality of stereo sound and a terminal, to solve the disadvantage that the difference of phases, frequency spectrums and amplitudes of sound signals of a left channel and a right channel causes the deterioration of the sound quality of stereo sound.

To solve the abovementioned technical problem, an embodiment of the present disclosure provides a method for improving the sound quality of stereo sound, which includes that: an original left channel signal and an original right channel signal are acquired; phases, frequency spectrums and amplitudes of the original left channel signal and the original right channel signal are acquired; a left calibrated signal is acquired according to the phase, frequency spectrum and amplitude of the original left channel signal, and a right calibrated signal is acquired according to the phase, frequency spectrum and amplitude of the original right channel signal; the left calibrated signal and the original right channel signal are superposed to generate a final right channel output signal; the right calibrated signal and the original left channel signal are superposed to generate a final left channel output signal; and the final right channel output signal and the final left channel output signal are combined to form a Pulse Code Modulation PCM signal.

In the method, the step that an original left channel signal and an original right channel signal are acquired includes that: the original left channel signal and the original right channel signal are extracted from decoded original stereo sound data.

In the method, the step that the phases of the original left channel signal and the original right channel signal are acquired includes that: the phase of the original left channel signal and the phase of the original right channel signal are acquired by using a deconvolution manner.

In the method, the step that the frequency spectrums and amplitudes of the original left channel signal and the original right channel signal are acquired includes that: the frequency spectrum and amplitude of the original left channel signal and the frequency spectrum and amplitude of the original right channel signal are acquired by using the Fourier transform.

In the method, the step that a calibration calculation is performed on the original left channel signal to generate the left calibrated signal according to the phase, frequency spectrum and amplitude of the original left channel signal includes that: according to a preset impedance of a stereo sound output port and return current ground, and the amplitude of the original left channel signal, a calibrated amplitude is calculated by using a voltage division manner, and a phase reversing process is performed on the phase of the original left channel signal to generate a phase for calibrating, and the calibrated amplitude, the phase and the frequency spectrum for calibrating are combined to form the left calibrated signal; the step that the calibration calculation is performed on the original right channel signal to generate the right calibrated signal according to the phase, frequency spectrum and amplitude of the original right channel signal includes that: according to a preset impedance of a stereo sound output port and return current ground, and the amplitude of the original right channel signal, the calibrated amplitude is calculated by using the voltage division manner, and the phase reversing process is performed on the phase of the original right channel signal to generate the phase for calibrating, and the calibrated amplitude, the phase and the frequency spectrum for calibrating are combined to form the right calibrated signal.

The embodiment of the present disclosure further provides a device for improving sound quality of stereo sound, which includes: an original signal acquiring unit, arranged to acquire the original left channel signal and the original right channel signal; a parameter acquiring unit, arranged to acquire the phases, frequency spectrums and amplitudes of the original left channel signal and the original right channel signal; a calibrated signal generating unit, arranged to acquire the left calibrated signal according to the phase, frequency spectrum and amplitude of the original left channel signal, and acquire the right calibrated signal according to the phase, frequency spectrum and amplitude of the original right channel signal; and a calibrating unit, arranged to superpose the left calibrated signal and the original right channel signal to generate the final right channel output signal, and superpose the right calibrated signal and the original left channel signal to generate the final left channel output signal, and combine the final right channel output signal and the final left channel output signal to form a PCM signal.

In the device, the parameter acquiring unit includes: a phase extracting module, arranged to acquire the phase of original left channel signal and the phase of the original right channel signal by using a deconvolution manner.

In the device, a frequency spectrum and amplitude extracting module is arranged to acquire the frequency spectrum and amplitude of the original left channel signal and the frequency spectrum and amplitude of the original right channel signal by using Fourier transform.

In the device, the calibrated signal generating unit includes: a left calibrated signal module, arranged to perform the calibration calculation on the original left channel signal to generate the left calibrated signal according to the phase, frequency spectrum and amplitude of the original left channel signal. The operations of the left calibrated signal module includes: according to a preset impedance of a stereo sound output port and return current ground, and the amplitude of the original left channel signal, the calibrated amplitude is calculated by using the voltage division manner, and the phase reversing process is performed on the phase of the original left channel signal to generate the phase for calibrating, and the calibrated amplitude, the phase and the frequency spectrum for calibrating are combined to form the left calibrated signal. The calibrated signal generating unit further includes: a right calibrated signal module, arranged to perform the calibration calculation on the original right channel signal to generate the right calibrated signal according to the phase, frequency spectrum and amplitude of the original right channel signal. The operations of the right calibrated signal module includes: according to a preset impedance of a stereo sound output port and return current ground, and the amplitude of the original right channel signal, the calibrated amplitude is calculated by using the voltage division manner, and the phase reversing process is performed on the phase of the original right channel signal to generate a phase for calibrating, and the calibrated amplitude, the phase and the frequency spectrum for calibrating are combined to form the right calibrated signal.

A terminal, which includes the device for improving sound quality of stereo sound, is provided. The device includes: an original signal acquiring unit, arranged to acquire the original left channel signal and the original right channel signal; a parameter acquiring unit, arranged to acquire the phases, frequency spectrums and amplitudes of the original left channel signal and the original right channel signal; a calibrated signal generating unit, arranged to acquire the left calibrated signal according to the phase, frequency spectrum and amplitude of the original left channel signal, and acquire the right calibrated signal according to the phase, frequency spectrum and amplitude of the original right channel signal; and a calibrating unit, arranged to superpose the left calibrated signal and the original right channel signal to generate the final right channel output signal, and superpose the right calibrated signal and the original left channel signal to generate the final left channel output signal, and combine the final right channel output signal and the final left channel output signal to form a PCM signal.

The technical solutions of the present disclosure have the following beneficial effect:

without increasing the hardware cost, and risk and complexity of hardware PCB and ID, the right calibrated signal and the left calibrated signal are calculated, and the left calibrated signal and the original right channel signal are superposed to generate the final right channel output signal, and the right calibrated signal and the original left channel signal are superposed to generate the final left channel output signal, and therefore, the problem of stereo sound output crosstalk between the left channel and the right channel is solved.

SPECIFIC EMBODIMENTS

To make the technical problems to be solved by the present disclosure, the technical solutions and advantages of the present disclosure clearer, a detailed description is made below in combination with the accompanying drawings and specific embodiments.

Frequencies, phases and amplitudes of original sound signals of a left channel and the right channel are processed by using an audio processing algorithm, to reduce a crosstalk between the left channel and the right channel.

Figure 1:
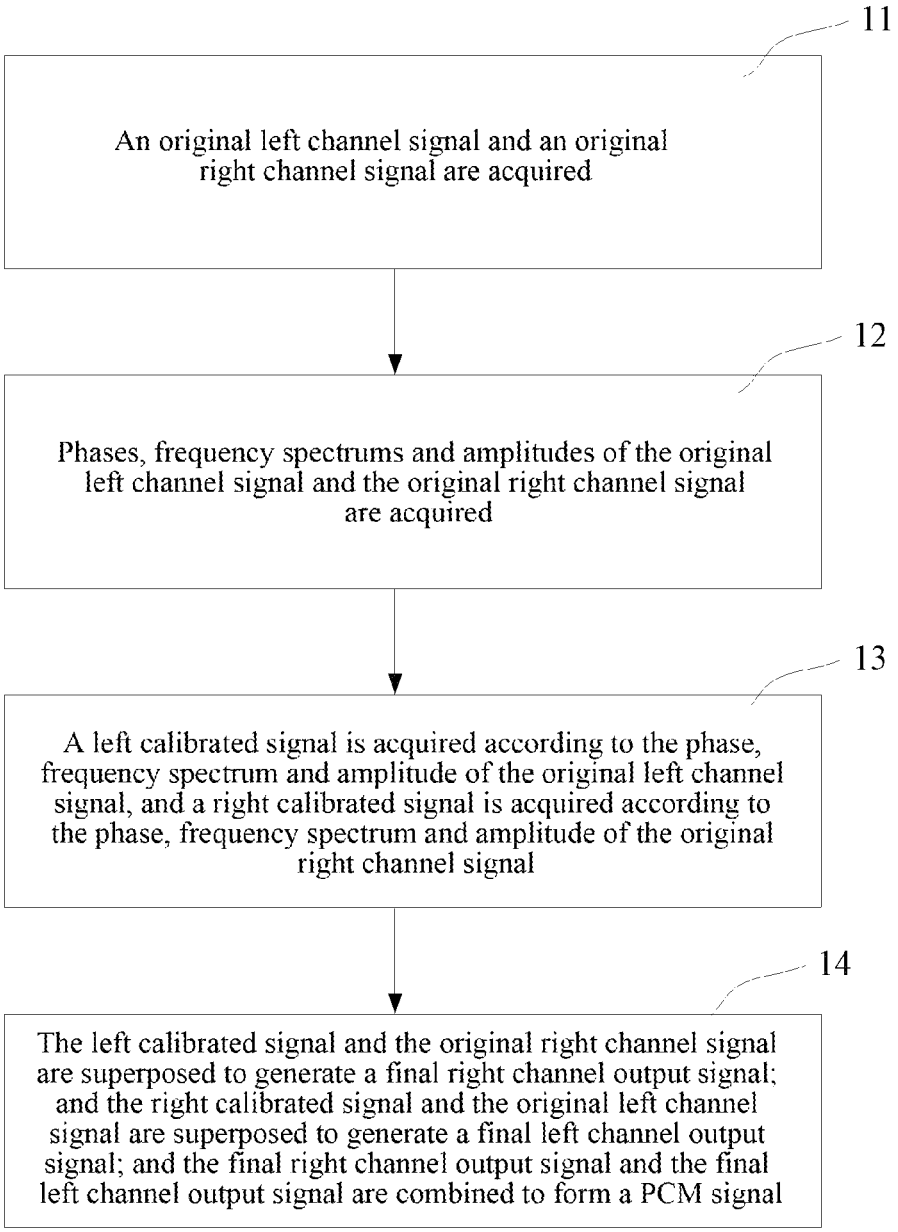
FIG. 1 is a flowchart of a method for improving the sound quality of stereo sound.

The embodiment of the present disclosure provides a method for improving sound quality of stereo sound. As shown in FIG. 1, the method includes the following steps.

In step 11, an original left channel signal and an original right channel signal are acquired.

In step 12, phases, frequency spectrums and amplitudes of the original left channel signal and the original right channel signal are acquired.

In step 13, a calibration calculation is performed on the original left channel signal to generate the left calibrated signal according to the phase, frequency spectrum and amplitude of the original left channel signal, and the calibration calculation is performed on the original right channel signal to generate the right calibrated signal according to the phase, frequency spectrum and amplitude of the original right channel signal.

In step 14, the left calibrated signal and the original right channel signal are superposed to generate a final right channel output signal; and the right calibrated signal and the original left channel signal are superposed to generate a final left channel output signal; and the final right channel output signal and the final left channel output signal are combined to form a PCM signal.

By the technology provided by the application, without increasing the hardware cost, and risk and complexity of PCB and Industrial Design, the right calibrated signal and the left calibrated signal are calculated, and the left calibrated signal and the original right channel signal are superposed to generate the final right channel output signal, and the right calibrated signal and the original left channel signal are superposed to generate the final left channel output signal. The technology provided by the application solves the problem of stereo sound output crosstalk between the left channel and the right channel.

It should be noted that, the flow of processing the original left channel signal is consistent with the flow of processing the original right channel signal.

Figure 2:
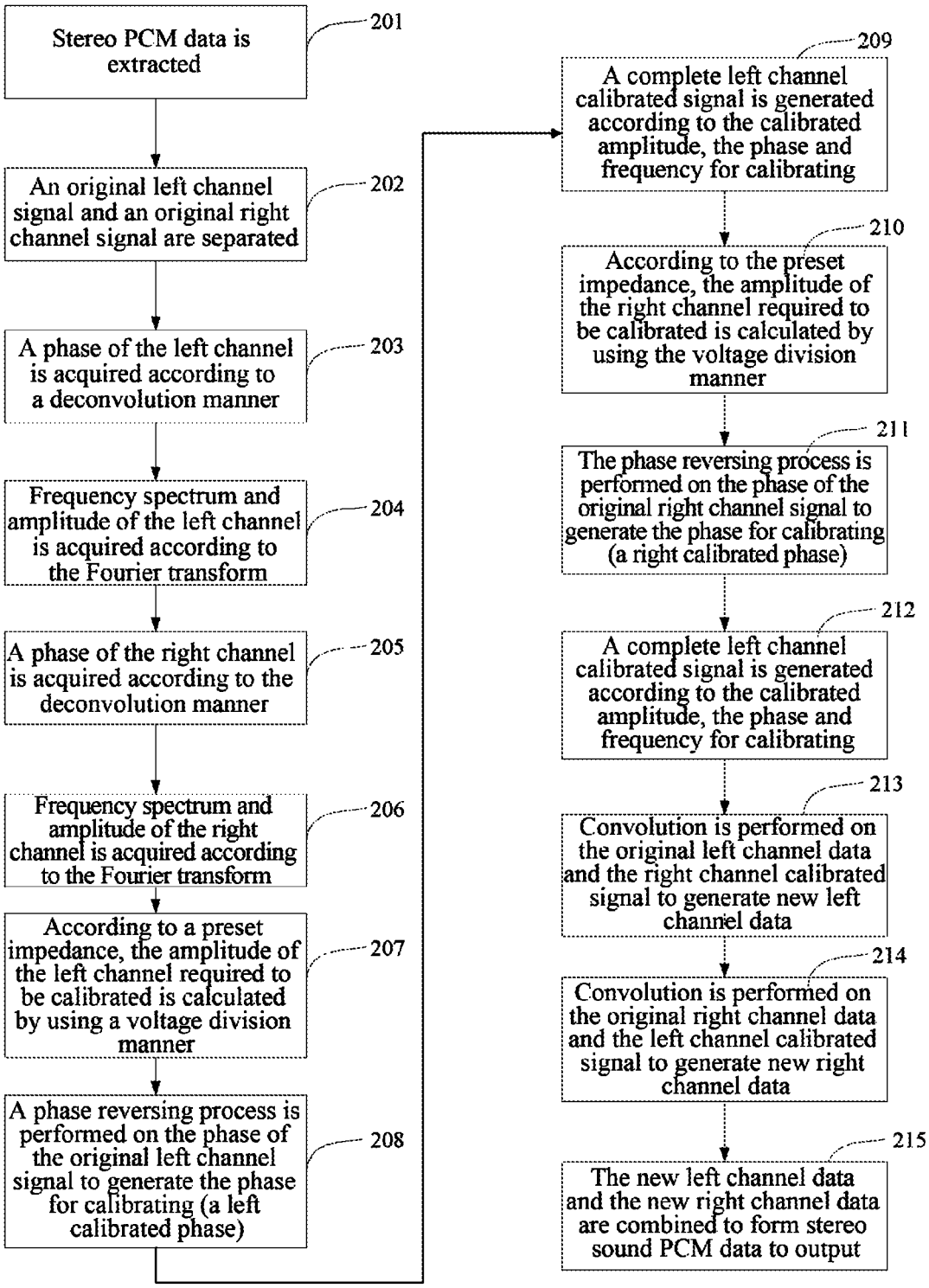
FIG. 2 is a flowchart of a process of improving the sound quality of stereo sound.

In an alternative embodiment, as shown in FIG. 2, the step that the original left channel signal and the original right channel signal are acquired includes that: the original left channel signal and the original right channel signal are extracted from decoded original stereo sound data.

In an alternative embodiment, the step that the phases of the original left channel signal and the original right channel signal are acquired includes that: the phase of original left channel signal and the phase of the original right channel signal are acquired by using the deconvolution manner.

In an alternative embodiment, the step that the frequency spectrums and amplitudes of the original left channel signal and the original right channel signal are acquired includes that: the frequency spectrum and amplitude of the original left channel signal and the frequency spectrum and amplitude of the original right channel signal are acquired by using the Fourier transform.

Figure 3:
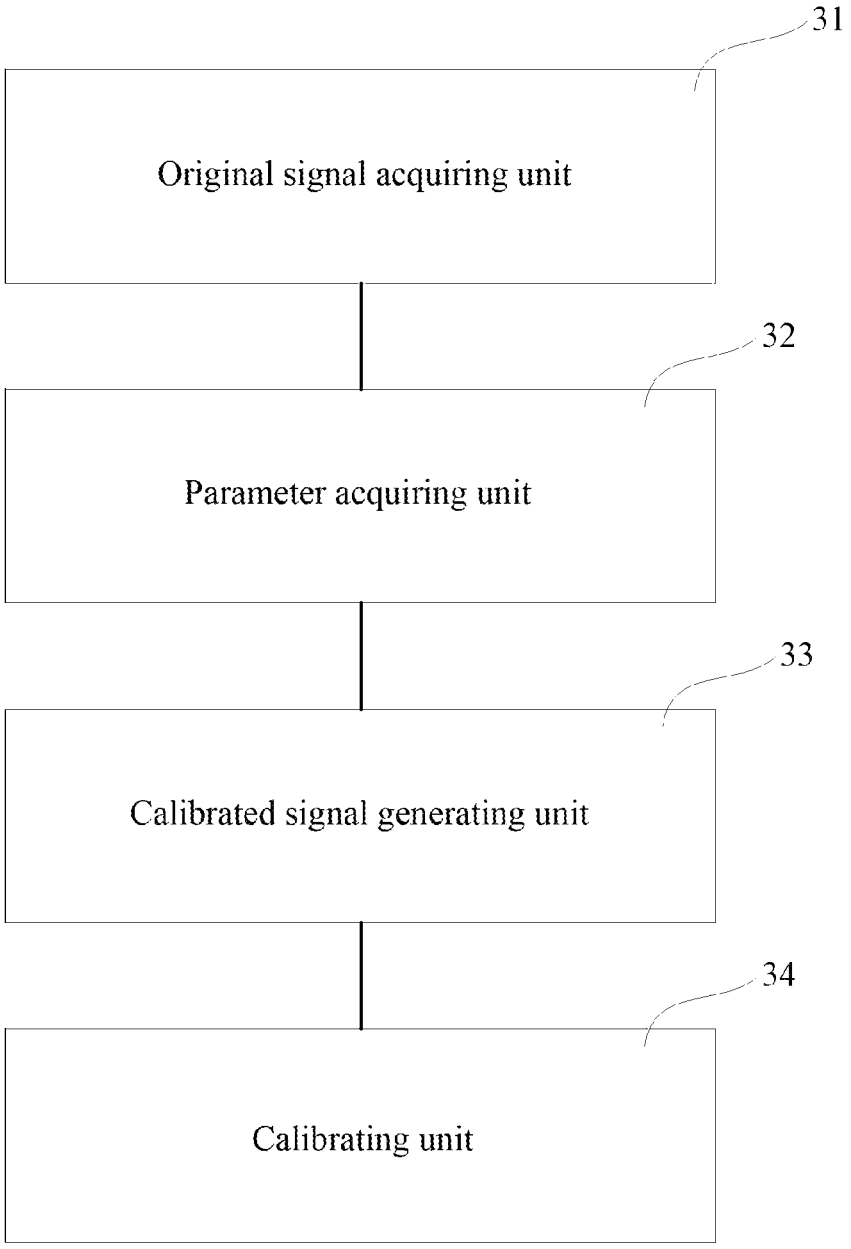
FIG. 3 is a structure diagram of a device for improving the sound quality of stereo sound.

In an alternative embodiment, as shown in FIG. 3, the step that the calibration calculation is performed on the original left channel signal to generate the left calibrated signal according to the phase, frequency spectrum and amplitude of the original left channel signal includes that: according to a preset impedance of stereo sound output port and return current grand, and the amplitude of the original left channel signal, a calibrated amplitude is calculated by using a voltage division manner, and a phase reversing process is performed on the phase of the original left channel signal to generate a phase for calibrating, and the calibrated amplitude, the phase and the frequency spectrum for calibrating are combined to form the left calibrated signal In an alternative embodiment, as shown in FIG. 3, the step that the calibration calculation is performed on the original right channel signal to generate the right calibrated signal according to the phase, frequency spectrum and amplitude of the original right channel signal includes that:

the step that the calibration calculation is performed on the original right channel signal to generate the right calibrated signal according to the phase, frequency spectrum and amplitude of the original right channel signal includes that: according to the preset impedance of the stereo sound output port and return current grand, and the amplitude of the original right channel signal, the calibrated amplitude is calculated by using the voltage division manner, and the phase reversing process is performed on the phase of the original right channel signal to generate the phase for calibrating, and the calibrated amplitude, the phase and the frequency spectrum for calibrating are combined to form the right calibrated signal.

Mathematically, performing the phase reversing process on the phase of the original left channel signal to generate the phase for calibrating, and performing the phase reversing process on the phase of the original right channel signal to generate the phase for calibrating may be implemented by using the Fourier inverse transform. During the Fourier inverse transform, correct phase information needs to be input. Herein, the correct phase refers to the phase which is acquired after inverse transform is performed based on the original phase, that is, n is added to the original phase. At the same time, the amplitude after voltage division is input; and then the transform from a frequency domain to a time domain waveform may be completed. Herein, the time domain waveform is the waveform which can be seen usually, as that seen on an oscilloscope.

Figure 6:
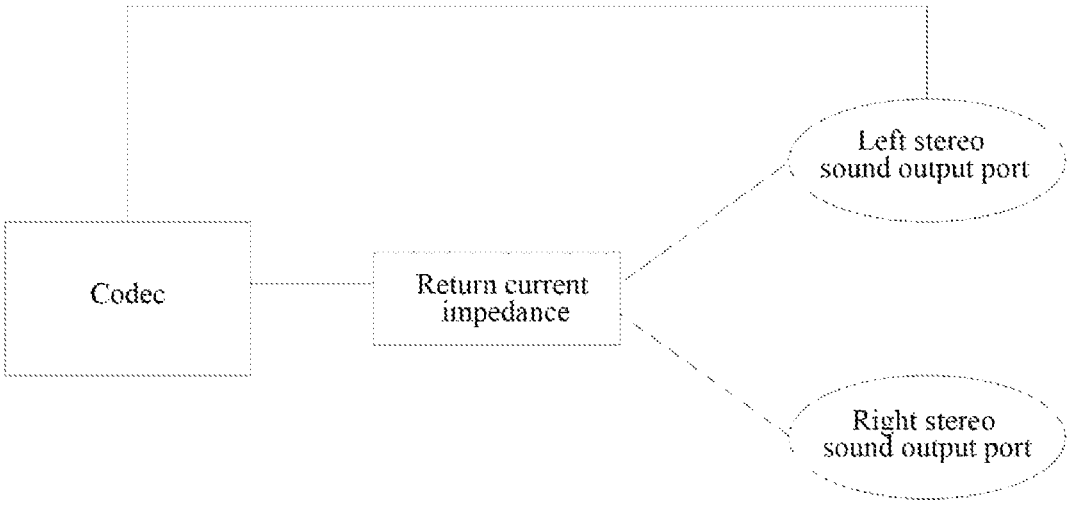
FIG. 6 is a schematic diagram of forming a return current impedance between a stereo sound output port and a codec.

As shown in FIG. 6, the reason of voltage division is the stereo sound port, such as a headphone jack, is far away from the codec, and the distance inevitably generates a return current impedance on physical hardware, and at this moment the headphone connected to the headphone jack will also be interfered by the return current impedance Rgnd. Therefore, voltage division is needed; and a divided voltage on the return current impedance will affect the sound quality of the stereo sound output port. The divided voltage value may be measured in advance and serves as a calibrated amplitude used in the calibrating process.

In an alternative embodiment, the method further includes that: a new left channel signal is combined according to the convolution manner, and a new right channel signal is combined according to the convolution manner.

In an application scenario, as shown in FIG. 2, the process of improving the sound quality of stereo sound includes the following steps.

In step 201, stereo data is extracted.

In step 202, an original left channel signal and an original right channel signal are separated.

In step 203, a phase of the left channel is acquired according to a convolution manner.

In step 204, frequency spectrum and amplitude of the left channel is acquired according to the Fourier transform.

In step 205, a phase of the right channel is acquired according to the convolution manner.

In step 206, frequency spectrum and amplitude of the right channel is acquired according to the Fourier transform.

In step 207, according to the preset impedance, the amplitude of the left channel required to be calibrated is calculated by using a voltage division manner.

In step 208, a phase reversing process is performed on the phase of the original left channel signal to generate the phase for calibrating, namely a left calibrated phase.

In step 209, a complete left channel calibrated signal is generated according to an inversion signal of the frequency corresponding to the calibrated amplitude.

In step 210, according to the preset impedance, the amplitude of the right channel required to be calibrated is calculated by using the voltage division manner.

In step 211, the phase reversing process is performed on the phase of the original right channel signal to generate the phase for calibrating, namely a right calibrated phase.

In step 212, a complete right channel calibrated signal is generated according to an inversion signal of the frequency corresponding to the calibrated amplitude.

In step 213, convolution is performed on the original left channel signal and the right channel calibrated signal to generate a final left channel output signal.

In step 214, convolution is performed on the original right channel signal and the left channel calibrated signal to generate a final right channel output signal.

In step 215, the new left channel data and the new right channel data are combined to form the stereo data to output.

It should be noted that, the flow of processing the original left channel signal is consistent with the flow of processing the original right channel signal, and there is no necessary to set different priorities between them. Therefore, the steps of implementing the same functions on the left channel and the right channel are performed without considering the time sequence.

The embodiment of the present disclosure provides a device for improving sound quality of stereo sound, which includes:

an original signal acquiring unit 31, arranged to acquire the original left channel signal and the original right channel signal;

a parameter acquiring unit 32, arranged to acquire the phases, frequency spectrums and amplitudes of the original left channel signal and the original right channel signal;

a calibrated signal generating unit 33, arranged to acquire the left calibrated signal according to the phase, frequency spectrum and amplitude of the original left channel signal, and acquire the right calibrated signal according to the phase, frequency spectrum and amplitude of the original right channel signal; and a calibrating unit 34, arranged to superpose the left calibrated signal and the original right channel signal to generate a final right channel output signal, and superpose the right calibrated signal and the original left channel signal to generate a final left channel output signal, and combine the final right channel output signal and the final left channel output signal to form the PCM signal.

In an alternative embodiment, the parameter acquiring unit 32 includes:

a phase extracting module, arranged to acquire the phase of original left channel signal and the phase of the original right channel signal by using a deconvolution manner.

In an alternative embodiment, the parameter acquiring unit 32 includes: a frequency spectrum and amplitude extracting module, arranged to acquire the frequency spectrum and amplitude of the original left channel signal and the frequency spectrum and amplitude of the original right channel signal by using Fourier transform.

In an alternative embodiment, the calibrated signal generating unit 33 includes the following modules.

A left calibrated signal module is arranged to perform the calibration calculation on the original left channel signal to generate the left calibrated signal according to the phase, frequency spectrum and amplitude of the original left channel signal. The operations of the left calibrated signal module includes: according to the preset impedance of stereo sound output port and return current ground, and the amplitude of the original left channel signal, the calibrated amplitude is calculated by using the voltage division manner; and a phase reversing process is performed on the phase of the original left channel signal to generate the phase for calibrating, and the calibrated amplitude, the phase and the frequency spectrum for calibrating are combined to form the left calibrated signal.

A right calibrated signal module is arranged to perform the calibration calculation on the original right channel signal to generate the right calibrated signal according to the phase, frequency spectrum and amplitude of the original right channel signal. The operations of the left calibrated signal module includes: according to the preset impedance of the stereo sound output port and return current ground, and the amplitude of the original right channel signal, the calibrated amplitude is calculated by using the voltage division manner; and the phase reversing process is performed on the phase of the original right channel signal to generate the phase for calibrating, and the calibrated amplitude, the phase and the frequency spectrum for calibrating are combined to form the right calibrated signal.

Figure 4:
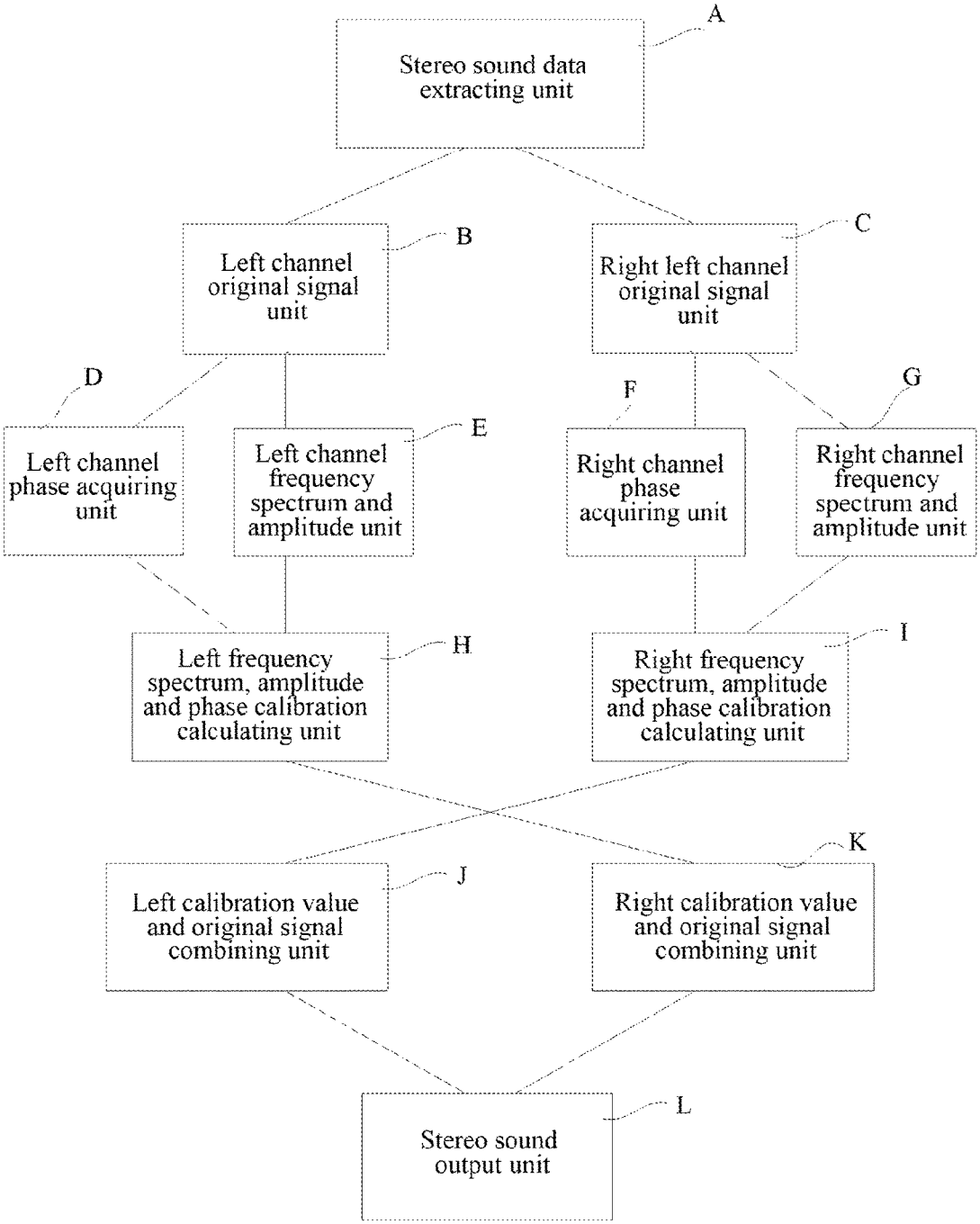
FIG. 4 is a working principle diagram of improving the sound quality of stereo sound.

As shown in FIG. 4, the device for improving the sound quality of stereo sound includes:

a stereo sound data extracting unit A, which is arranged to extract the original stereo sound data decoded by the terminal and takes charge of reading the decoded original stereo sound data into a unit for processing; the read original stereo sound data needs to be separated into the separate original left channel signal and original right channel signal for the subsequent processing, which is separately completed by units B and C in the original signal acquiring unit 31.

The original signal acquiring unit 31 includes a left channel original signal unit B and a right left channel original signal unit C, which separate the left channel and the right channel.

A phase extracting function unit in the parameter acquiring unit 32 includes: a left channel phase acquiring unit D and a right channel phase acquiring unit F, which have the same function and acquire the phases of the left channel signal and the right channel signal respectively.

A frequency spectrum and amplitude extracting function unit in the parameter acquiring unit 32 includes: a left channel frequency spectrum and amplitude unit E and a right channel frequency spectrum and amplitude unit G, which acquire the frequency spectrum and amplitude information of the left channel signal and the right channel signal respectively.

Herein, the left channel phase acquiring unit D and the right channel phase acquiring unit F respectively perform phase deconvolution analysis on the left channel signal and the right channel signal to acquire the correct phase. The left channel frequency spectrum and amplitude unit E and the right channel frequency spectrum and amplitude unit G perform the Fast Fourier Transform FFT on each original channel signal to acquire the frequency spectrum and amplitude.

The calibrated signal generating unit 33 includes: a left frequency spectrum, amplitude and phase calibration calculating unit H and a right frequency spectrum, amplitude and phase calibration calculating unit I, which calculate the calibrated signals required to be generated. The calibrated signal which may be applied to another channel is generated according to the preset impedance from the stereo sound output port to the return current ground of the codec chip in advance and the phase and frequency spectrum of the channel.

Figure 5:
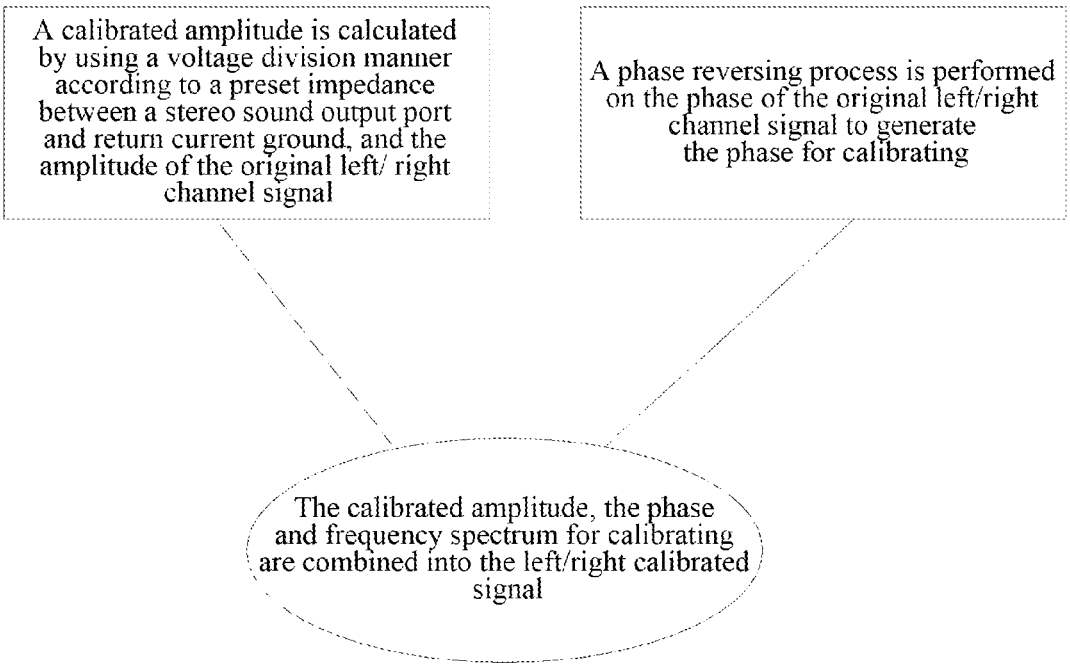
FIG. 5 is a working principle diagram of calculating a phase, frequency spectrum and amplitude.

Herein, the left frequency spectrum, amplitude and phase calibration calculating unit H and the right frequency spectrum, amplitude and phase calibration calculating unit I have the same function, and they calculate the calibrated signals by using the voltage division manner according to the acquired phase, frequency spectrum and amplitude in combination with the preset impedance of the stereo sound output port and return current ground of the codec. Specifically, as shown in FIG. 5, the operations include that: the amplitude required to be calibrated is calculated by using the voltage division manner according to the preset value of the return current impedance and the original amplitude; and the phase inversing process is performed on the corresponding frequency according to the extracted phase in the previous step, to generate new phase and frequency spectrum required to be calibrated; and a final calibrated signal which may be applied to another channel is combined.

The calibrating unit 34 includes: a left calibration value and original signal combining unit J, a right calibration value and original signal combining unit K, and a stereo sound output unit L, whose function is to combine the calibrated signal and the original signal.

The left calibration value and original signal combining unit J combines a new left channel signal, namely the final left channel output signal, by using the convolution manner according to the left channel information and the calibrated signal of the right frequency spectrum, amplitude and phase calibration calculating unit I. The right calibration value and original signal combining unit K combines a new right channel signal, namely the final right channel output signal, by using the convolution manner according to the right channel information and the calibrated signal of the left frequency spectrum, amplitude and phase calibration calculating unit H.

The stereo sound output unit L outputs the processed left and right channel signals in the PCM form.

In an application scenario, as shown in FIG. 4, the process of improving the sound quality of stereo sound includes the following steps.

In step 41, the stereo sound data extracting unit A extracts the original stereo sound data from a PCM interface for the subsequent processing.

In step 42, the left channel original signal unit B and the right left channel original signal unit C separate the original signal into the left channel original signal and the right channel original signal respectively, that is, the left channel original signal is acquired from the left channel original signal unit B, and the right channel original signal is acquired from the right channel original signal unit C. The left channel original signal and the right channel original signal are respectively transmitted to the left channel phase acquiring unit D, the left channel frequency spectrum and amplitude unit E, and the right channel phase acquiring unit F and the right channel frequency spectrum and amplitude unit G.

In step 43, the left channel phase acquiring unit D and the left channel frequency spectrum and amplitude unit E process the left channel data, and the right channel phase acquiring unit F and the right channel frequency spectrum and amplitude unit G process the right channel data, whose purpose is to acquire information about the phases, frequency spectrums and amplitudes of the original left channel signal and the original right channel signal. Then the information is transferred to the left frequency spectrum, amplitude and phase calibration calculating unit H and the right frequency spectrum, amplitude and phase calibration calculating unit I.

In step 44, the left frequency spectrum, amplitude and phase calibration calculating unit H and the right frequency spectrum, amplitude and phase calibration calculating unit I perform the calibration calculation on the original left channel signal and the original right channel signal according to the preset impedance information of the stereo sound output port and return current ground, whose purpose is to generate a corresponding inversion signal for superposition of another channel.

In step 45, the calculated left channel calibrated signal and right channel calibrated signal are combined again in the left calibration value and original signal combining unit J and the right calibration value and original signal combining unit K, to generate the final left channel output signal containing the right channel calibrated signal and the final right channel output signal containing the left channel calibrated signal; at last, the stereo sound output unit L combines the two signals into the PCM signal to output.

The embodiment of the present disclosure further provides a terminal, which includes a device for improving the sound quality of stereo sound. The device includes:

an original signal acquiring unit, arranged to acquire an original left channel signal and an original right channel signal;

a parameter acquiring unit, arranged to acquire phases, frequency spectrums and amplitudes of the original left channel signal and the original right channel signal;

a calibrated signal generating unit, arranged to acquire left calibrated signal according to the phase, frequency spectrum and amplitude of the original left channel signal, and acquire right calibrated signal according to the phase, frequency spectrum and amplitude of the original right channel signal; and a calibrating unit, arranged to superpose the left calibrated signal and the original right channel signal to generate a final right channel output signal, and superpose the right calibrated signal and the original left channel signal to generate a final left channel output signal, and combine the final right channel output signal and the final left channel output signal to form a PCM signal.

The advantages after adopting the solution are as follows: the problem of stereo sound output crosstalk between the left channel and the right channel is solved without increasing the hardware cost and risk and complexity of PCB and ID.

The above are only the alternative implementations of the present disclosure. It should be indicated that, on the premise of not departing from the principles of the present disclosure, those ordinary skilled in the art may further make a number of improvements and modifications, and these improvements and modifications should be deemed within the scope of protection of the present disclosure.

INDUSTRIAL APPLICABILITY

As abovementioned, by means of the embodiments and alternative implementations, the problem of stereo sound output crosstalk between the left channel and the right channel is solved without increasing the hardware cost and risk and complexity of hardware PCB and ID.

What we claim is:

1. A method for improving sound quality of stereo sound, comprising:

acquiring an original left channel signal and an original right channel signal;

acquiring phases, frequency spectrums and amplitudes of the original left channel signal and the original right channel signal;

acquiring a left calibrated signal according to the phase, frequency spectrum and amplitude of the original left channel signal, and acquiring a right calibrated signal according to the phase, frequency spectrum and amplitude of the original right channel signal; and superposing the left calibrated signal and the original right channel signal to generate a final right channel output signal, and superposing the right calibrated signal and the original left channel signal to generate a final left channel output signal, and combining the final right channel output signal and the final left channel output signal to form a Pulse Code Modulation (PCM) signal, wherein, performing a calibration calculation on the original left channel signal to generate the left calibrated signal according to the phase, frequency spectrum and amplitude of the original left channel signal comprises: according to a preset impedance of a stereo sound output port and return current ground, and the amplitude of the original left channel signal, calculating a calibrated amplitude by using a voltage division manner, and performing a phase reversing process on the phase of the original left channel signal to generate a phase for calibrating, and combining the calibrated amplitude, the phase and frequency spectrum for calibrating to form the left calibrated signal;

performing the calibration calculation on the original right channel signal to generate the right calibrated signal according to the phase, frequency spectrum and amplitude of the original right channel signal comprises: according to a preset impedance of a stereo sound output port and return current ground, and the amplitude of the original right channel signal, calculating a calibrated amplitude by using the voltage division manner, and performing the phase reversing process on the phase of the original right channel signal to generate a phase for calibrating, and combining the calibrated amplitude, the phase and frequency spectrum for calibrating to form the right calibrated signal.

2. The method according to claim 1, wherein acquiring an original left channel signal and an original right channel signal comprises: extracting the original left channel signal and the original right channel signal from decoded original stereo sound data.

3. The method according to claim 1, wherein acquiring phases of the original left channel signal and the original right channel signal comprises: acquiring the phase of the original left channel signal and the phase of the original right channel signal by using a deconvolution manner.

4. The method according to claim 1, wherein acquiring frequency spectrums and amplitudes of the original left channel signal and the original right channel signal comprises: using Fourier transform to acquire the frequency spectrum and amplitude of the original left channel signal and the frequency spectrum and amplitude of the original right channel signal.

5. A device for improving sound quality of stereo sound, comprising a processor and a storage device, wherein the storage device stores processor-executable programs, and the processor-executable programs comprise:

an original signal acquiring unit, arranged to acquire an original left channel signal and an original right channel signal;

a parameter acquiring unit, arranged to acquire phases, frequency spectrums and amplitudes of the original left channel signal and the original right channel signal;

a calibrated signal generating unit, arranged to acquire a left calibrated signal according to the phase, frequency spectrum and amplitude of the original left channel signal, and acquire a right calibrated signal according to the phase, frequency spectrum and amplitude of the original right channel signal; and a calibrating unit, arranged to superpose the left calibrated signal and the original right channel signal to generate a final right channel output signal, and superpose the right calibrated signal and the original left channel signal to generate a final left channel output signal, and combine the final right channel output signal and the final left channel output signal to form a Pulse Code Modulation (PCM) signal, wherein the calibrated signal generating unit comprises:

a left calibrated signal module, arranged to perform a calibration calculation on the original left channel signal to generate the left calibrated signal according to the phase, frequency spectrum and amplitude of the original left channel signal, comprising: according to a preset impedance of a stereo sound output port and return current ground, and the amplitude of the original left channel signal, calculating a calibrated amplitude by using a voltage division manner, and performing a phase reversing process on the phase of the original left channel signal to generate a phase for calibrating, and combining the calibrated amplitude, the phase and the frequency spectrum for calibrating to form the left calibrated signal;

a right calibrated signal module, arranged to perform the calibration calculation on the original right channel signal to generate the right calibrated signal according to the phase, frequency spectrum and amplitude of the original right channel signal, comprising: according to a preset impedance of a stereo sound output port and return current ground, and the amplitude of the original right channel signal, calculating a calibrated amplitude by using the voltage division manner, and performing the phase reversing process on the phase of the original right channel signal to generate a phase for calibrating, and combining the calibrated amplitude, the phase and the frequency spectrum for calibrating to form the right calibrated signal.

6. The device according to claim 5, wherein the parameter acquiring unit comprises:

a phase extracting module, arranged to acquire the phase of original left channel signal and the phase of the original right channel signal by using a deconvolution manner.

7. The device according to claim 5, wherein the parameter acquiring unit comprises:

a frequency spectrum and amplitude extracting module is arranged to use Fourier transform to acquire the frequency spectrum and amplitude of the original left channel signal and the frequency spectrum and amplitude of the original right channel signal.

8. A terminal, comprising a device for improving sound quality of stereo sound; the device comprises a processor and a storage device, wherein the storage device stores processor-executable programs, and the processor-executable programs comprise:

an original signal acquiring unit, arranged to acquire an original left channel signal and an original right channel signal;

a parameter acquiring unit, arranged to acquire phases, frequency spectrums and amplitudes of the original left channel signal and the original right channel signal;

a calibrated signal generating unit, arranged to acquire a left calibrated signal according to the phase, frequency spectrum and amplitude of the original left channel signal, and acquire a right calibrated signal according to the phase, frequency spectrum and amplitude of the original right channel signal; and a calibrating unit, arranged to superpose the left calibrated signal and the original right channel signal to generate a final right channel output signal, and superpose the right calibrated signal and the original left channel signal to generate a final left channel output signal, and combine the final right channel output signal and the final left channel output signal to form a Pulse Code Modulation (PCM) signal, wherein the calibrated signal generating unit comprises:

a left calibrated signal module, arranged to perform a calibration calculation on the original left channel signal to generate the left calibrated signal according to the phase, frequency spectrum and amplitude of the original left channel signal, comprising: according to a preset impedance of a stereo sound output port and return current ground, and the amplitude of the original left channel signal, calculating a calibrated amplitude by using a voltage division manner, and performing a phase reversing process on the phase of the original left channel signal to generate a phase for calibrating, and combining the calibrated amplitude, the phase and the frequency spectrum for calibrating to form the left calibrated signal;

a right calibrated signal module, arranged to perform the calibration calculation on the original right channel signal to generate the right calibrated signal according to the phase, frequency spectrum and amplitude of the original right channel signal, comprising: according to a preset impedance of a stereo sound output port and return current ground, and the amplitude of the original right channel signal, calculating a calibrated amplitude by using the voltage division manner, and performing the phase reversing process on the phase of the original right channel signal to generate a phase for calibrating, and combining the calibrated amplitude, the phase and the frequency spectrum for calibrating to form the right calibrated signal.

* * * * *